US005527180A

United States Patent [19]

Robinson et al.

[11] Patent Number: 5,527,180

[45] Date of Patent: Jun. 18, 1996

[54] INFRARED BURNER

[75] Inventors: Edgar C. Robinson, Vancouver; Leonard Fleming, Delta, both of Canada

[73] Assignee: International Thermal Investments Ltd., Richmond, Canada

[21] Appl. No.: 272,819

[22] Filed: Jul. 11, 1994

Related U.S. Application Data

[63] Continuation-in-part of Ser. No. 89,763, Jul. 9, 1993, Pat. No. 5,391,075.

[51] Int. Cl.[6] ..... F23Q 7/06

[52] U.S. Cl. ..... 431/258; 431/350; 431/188; 431/354

[58] Field of Search ..... 431/258, 350, 431/188, 115, 354, 116

[56] References Cited

U.S. PATENT DOCUMENTS

| | | | |
|---|---|---|---|
| Re. 28,679 | 1/1976 | Robinson . | |
| 3,875,477 | 4/1975 | Fredricksson et al. | 431/66 X |
| 5,052,311 | 10/1991 | Kincaid | 126/500 |
| 5,102,328 | 4/1992 | Robinson . | |
| 5,391,075 | 2/1995 | Robinson et al. | 431/258 |

*Primary Examiner*—Larry Jones
*Attorney, Agent, or Firm*—John Russell Uren

[57] ABSTRACT

A burner has a burner tube and a nozzle holder mounted in one end of the burner tube. An igniter is positioned within the nozzle holder and acts to ignite any of the multi-liquid fuels which may be used with the burner. A nozzle emits atomized liquid fuel under the venturi effect of the nozzle with compressed air being supplied to the nozzle. Primary air holes extend circumferentially around the nozzle holder to admit air radially which passes directly to the burner tube. Secondary air holes extend around the inside circumference of the burner tube on the secondary air injection plate and admit air axially to the burner tube.

16 Claims, 8 Drawing Sheets

INFRARED BURNER

CROSS-REFERENCE TO RELATED APPLICATION

This application is a continuation-in-part of application Ser. No. 08/089,763 filed Jul. 9, 1993, now issued as U.S. Pat. No. 5,391,075 dated Feb. 21, 1995.

INTRODUCTION

This invention relates to a multi-fuel burner and, more particularly, to a multi-liquid fuel burner utilizing an igniter and a nozzle holder which emits atomized fuel and which utilizes a heated burner tube to an infrared condition under operation.

BACKGROUND OF THE INVENTION

It is desirable in many applications to have a burner which will operate using a plurality of fuels. Such a burner is described and claimed in Reissue U.S. Pat. No. 28,679 naming the same inventor as named in the present application. The use of a multi-fuel burner is desirable because it may be operated with fuel as is readily available in the operating environment where the burner is utilized. For example, in the high north, construction and mining equipment may operate with diesel fuel. It is convenient to use such a fuel for operating the burner.

The burner illustrated and disclosed in Reissue U.S. Pat. No. 28,679 and in U.S. Pat. No. 5,102,328, however, utilize in the first instance a round flame grid and, in the second instance, a cylindrical flame grid which are convenient for the particular applications under which they may be used. In other applications, however, it is convenient to utilize a flame grid having a different configuration which may be designed and manufactured for far less expense and which may be used, for example, for water heating and for oven heating, which oven may be used in a field kitchen by the military. A furnace may also utilize the burner which furnace distributes the hot air by using appropriate ducting.

Heretofore, the multi-fuel burner according to the aforementioned patents has used an ignition electrode to provide for the initial combustion of the atomized liquid fuel which is emitted from the nozzle by the venturi action of the primary air in the nozzle. Ignition electrodes, however, have a gap in which the distance is critical. The tips of such electrodes can also burn off until the electrode eventually becomes inoperable and a relatively high amount of power is required to form the spark on the electrode. Thus, relatively high maintenance is required to keep the ignition electrode in optimum condition and replacement is, of course, required from time to time.

Although igniters have been used with gaseous systems such as propane as described in U.S. Pat. No. 3,875,477, it has not been contemplated that an igniter may be used with atomized liquid fuels. Although propane is stored in a liquid form, when the pressure is released on the liquid, the propane is ejected by the nozzle in gaseous form. The propane will be ignited when it passes over the igniter.

The place of introduction of secondary air is important. For example, if it is desired that combustion occur on an external grid rather than internally of the burner tube, the secondary air is added at a location where it supports combustion on the grid and not within the burner tube.

SUMMARY OF THE INVENTION

According to one aspect of the invention, there is provided an infrared burner comprising a burner tube, a nozzle holder operably connected to said burner tube, a nozzle operably inserted in said nozzle holder to eject atomized fuel from said nozzle into said burner tube, an igniter mounted in said nozzle holder such that said igniter is in the path of said atomized fuel emitted from said nozzle, a closure member for said burner tube, said closure member closing said burner tube at the end of said burner tube remote from said burner tube and radially directed holes through the outside of the length of said burner tube extending longitudinally therealong.

According to a further aspect of the invention, there is provided a heater body comprising a combustion chamber, a flat, upper surface, an opening to allow mounting of a burner within said combustion chamber and a chimney mount extending from said chimney mount comprising outer and inner collar members joined together below the flat upper surface, and a chimney operable to be mounted between the inner and outer collar members.

BRIEF DESCRIPTION OF THE SEVERAL VIEWS OF THE DRAWINGS

Specific embodiments of the invention will now be described by example only, with the use of drawings in which.

DESCRIPTION OF SPECIFIC EMBODIMENT

Figure 1:
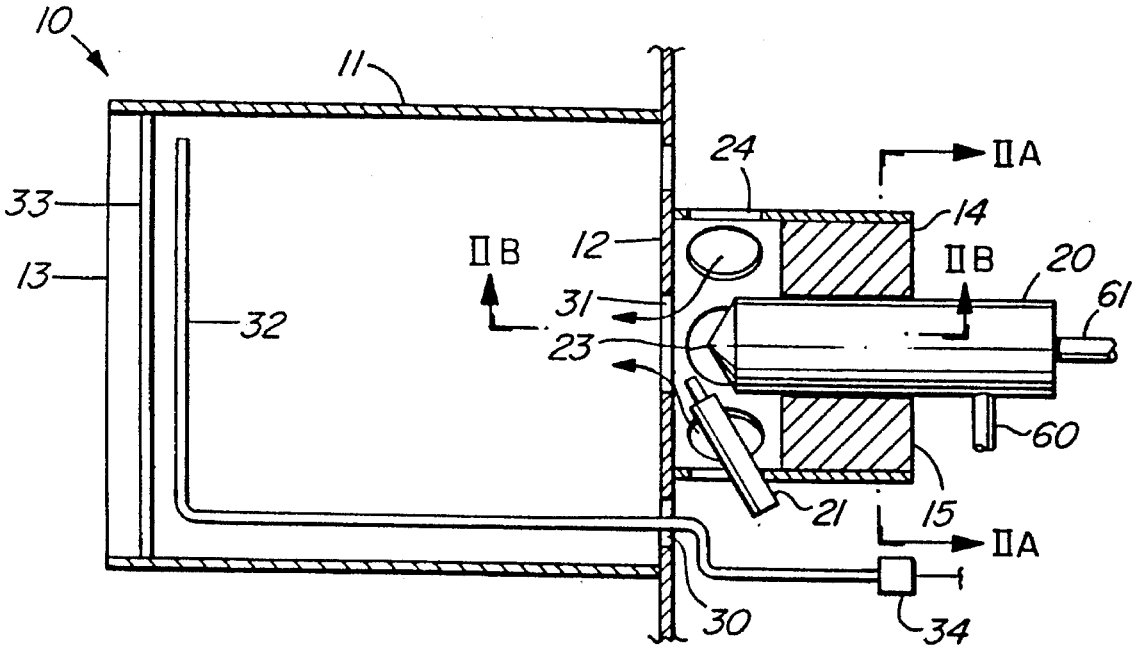
FIG. 1 illustrates a burner according to the invention having a burner tube in which combustion takes place with a nozzle holder connected to the end of the burner tube in accordance with the present invention.

Referring now to the drawings, a burner according to the invention is generally illustrated at 10 in FIG. 1. It comprises a burner tube 11 with one end having a secondary air injection plate 12. The opposite end 13 of the burner tube 11 is open.

The secondary air injection plate 12 is operably connected to a nozzle holder 14. Nozzle holder 14 is adapted to allow the mounting of a nozzle 20 in one end 15 of the nozzle holder 14 and also to allow an igniter 21 to be mounted on an inclined radial to the nozzle holder 14 as is illustrated. A typical igniter that may be utilized in this application is a NORTON hot surface igniter and, in particular, the NORTON Model 301 igniter which is more completely described, for example, in U.S. Pat. No. 3,875,477 entitled SILICON CARBIDE RESISTANCE IGNITER, the disclosure of which is hereby incorporated by reference. The igniter 21 has a tip 22 which is located a distance from the apex 23 of the nozzle 20 such that when atomized liquid is emitted from the nozzle 20, the tip 22, when heated, allows the atomized fuel to be ignited as will be described.

A plurality of circumferential holes 24, conveniently eight (8) in number, are located about the periphery of the nozzle holder 14 and allow primary air to enter the nozzle holder 14 and to proceed directly, without diversion, to the burner tube 11 as is indicated by the arrows.

A plurality of circumferential secondary air holes 30 are located about the inside circumference of the burner tube 11 and are drilled through the secondary air injection plate 12 in the positions illustrated. A central circumferential aperture 31 allows ingress of the atomized fuel from the nozzle 20 into the burner tube 11 where combustion occurs.

A flame rod 32 is located in the burner tube 11 and is operable to pass current between the flame rod 32 and ground 33 operably mounted across the burner tube 11 so as to indicate the presence or absence of a flame. A voltage source 34 supplies the necessary power to the flame rod 32.

Nozzle 20 has a source of liquid fuel 60 which is provided to the nozzle 20. Compressed air is also provided to the nozzle 20 through a compressed air line 61.

OPERATION

In operation, the igniter 21 is switched on and tip 22 immediately heats to a temperature which will ignite the atomized liquid being emitted from the apex 23 of nozzle 20 under the suction or venturi effect of the compressed air entering line 61 and leaving nozzle 20. The atomized liquid fuel which may be gasoline, jet fuel, waste oil, diesel fuel, heating oil or the like is ignited by the tip 22 of the guide 21 and pass through the centrally located circumferential aperture 31 where combustion takes place within the burner tube 11. Following the ignition of the atomized fuel in the burner tube 11 and the increase in temperature of the burner tube 11 to allow the combustion to be self sustaining, the igniter 21 will terminate operation. The flame rod 32 senses the presence of a flame in the burner tube 11 as is known. In the event no flame is present, the flame rod 32 will immediately act to shut down the burner 10.

The primary air passes radially through the circumferential primary air holes 24 from the atmosphere. It then passes directly to the burner tube 11 as is illustrated by the arrows in FIG. 1. The secondary air passes axially through the secondary air holes 30 on the secondary air injection plate 12 and act to support combustion within the burner tube 11.

Figure 2A:
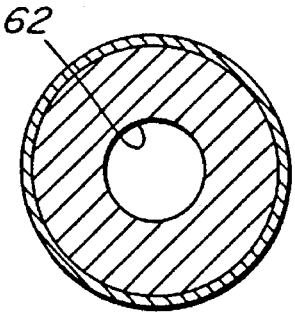
FIGS. 2A and 2B are sectional and end views of the nozzle holder according to the invention taken along IIA and IIB of FIG. 1, respectively.
Figure 2B:
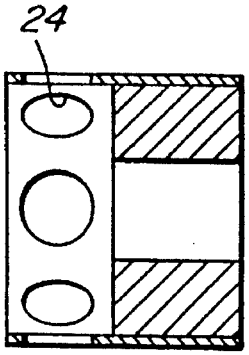

The nozzle holder 14 is shown in more detail in FIGS. 2A and 2B. A hole 62 is machined in the nozzle holder 14 to allow the nozzle 20 (FIG. 1) to be held by the nozzle holder 14. The primary air holes 24 are located about the circumference of the nozzle holder 14 and are used to allow primary air to radially enter into the nozzle holder 14 and, thence, to pass directly to the burner tube 11.

Figure 4A:
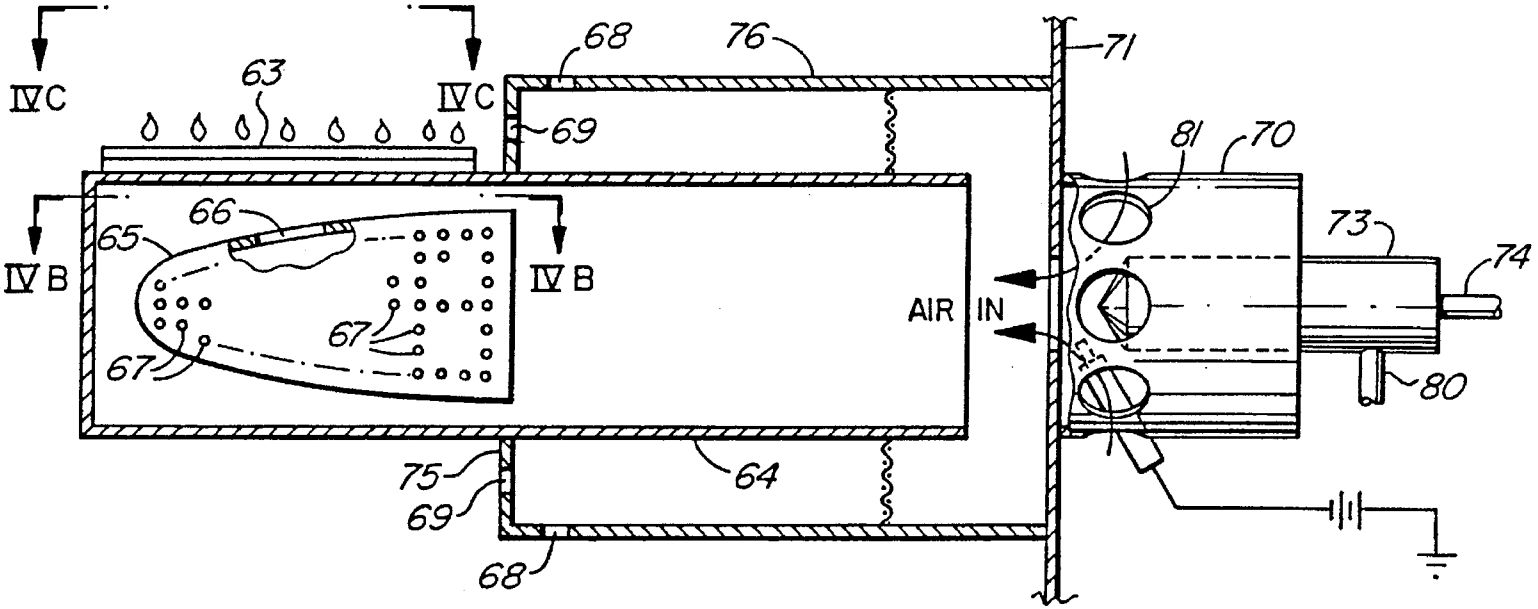
FIG. 4A is a view of the burner according to the invention utilizing a rectangular flame grid and baffle in a furnace or oven heating application.
Figure 4C:
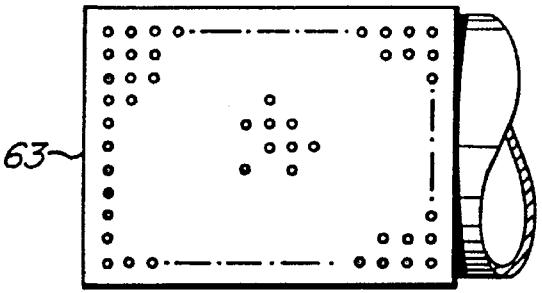
FIG. 4C is a plan view of the rectangular flame grid of the burner according to FIG. 4A.
Figure 4B:
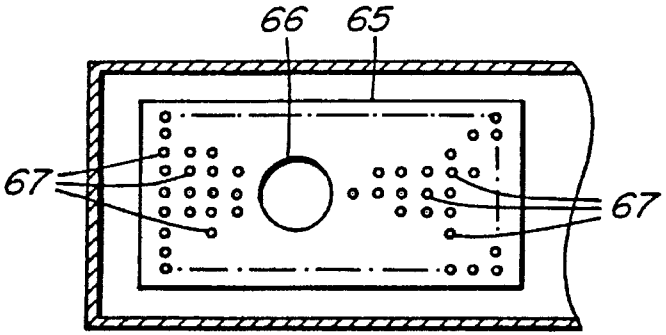
FIG. 4B is a view of the baffle within the burner tube taken along IVB—IVB of FIG. 4A.

A further embodiment of an apparatus with which the burner according to the invention is used is illustrated in FIGS. 4A, 4B and 4C. This embodiment is used, for example, where it is desired to heat an oven such as a stove in a field kitchen as might be used by the military and the like. In this case, the air injection plate 71 will have no secondary holes surrounding the nozzle holder 70 and the burner tube 64 will be located a distance away from the air injection plate 71 as is illustrated. A rectangular or square flame grid 63 faces upwardly and is connected to one end of the burner tube 64. A U-shaped baffle 65 is positioned within the burner tube 64 so that the fuel passes through the baffle 65 on the way to the rectangular grid 63. The baffle 65 has a centrally located pilot hole 66 and a plurality of holes 67 to allow passage of the fuel to the grid 63. The nozzle holder 70 is mounted directly to the injection plate 71 and, upon the tip of the igniter 72 igniting the atomized fuel being ejected from the nozzle 73 under the influence of air being provided through the compressed air line 74 and the liquid fuel being provided through fuel line 80, primary air enters the primary air holes 81 and passes directly to the burner tube 64 to support combustion on flame grid 63. It will be particularly noted that no secondary air holes are provided in the injection plate 71 because the combustion is not taking place within the burner tube 64 but, rather, on the rectangular flame grid 63. However, secondary air intake holes 68, 69 are located in the jacket 76 surrounding the burner tube 64 about the outside circumference of the jacket 76 and the circumference of the end 75 of the jacket 76, respectively.

Figure 3:
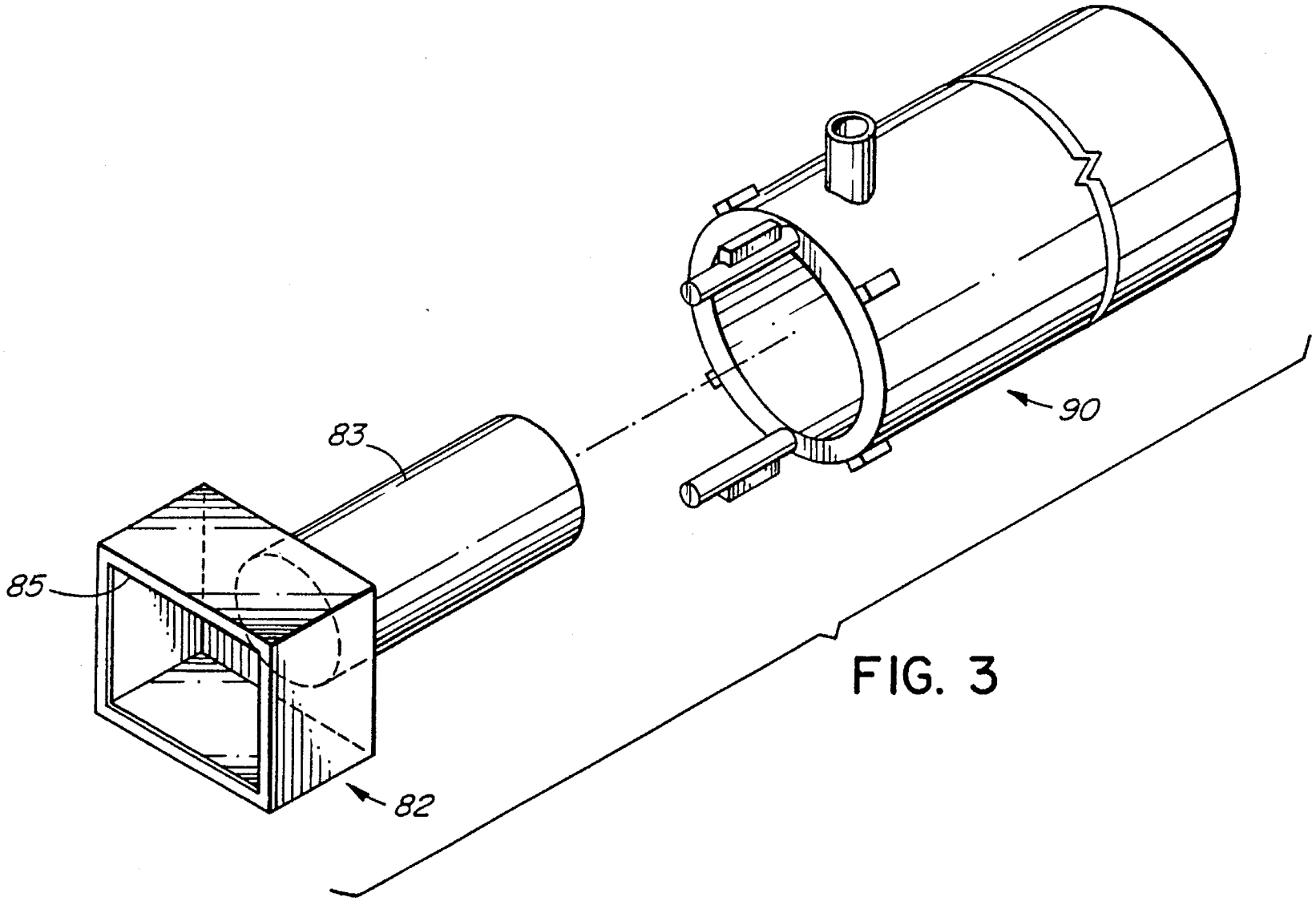
FIG. 3 is an exploded view of several of the operating components of a hot water heater into one end of which is inserted a burner according to FIG. 1.

A further embodiment of the invention is shown in FIG. 3 which illustrates several operating components of a hot water heater. The burner according to the invention as illustrated in FIG. 1 is inserted directly into the end 85 of the housing generally shown at 82. The burner tube 11 (FIG. 1) extends into cylinder 83 and cylinder 83, in turn, extends into the water jacket generally illustrated at 84.

In operation, and upon initial combustion of the atomized fuel within burner tube 11, the cylinder 83 will be heated. Cylinder 83 will provide heat to the water jacket 90 and the water will be heated.

Instead of a flame rod 32, a photocell could be used which senses the presence or absence of a flame in the burner tube 11.

Figure 5A:
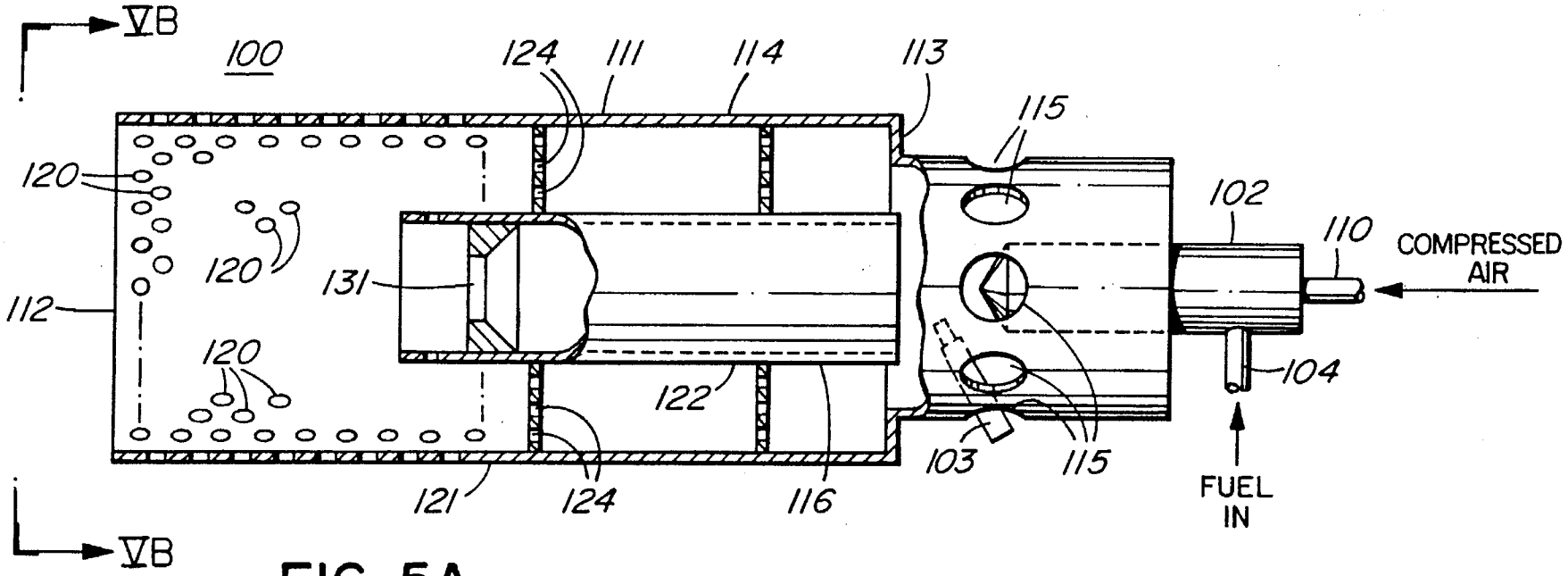
FIG. 5A is a side, partially sectioned diagrammatic view of an infrared burner according to a further aspect of the invention.
Figure 5B:
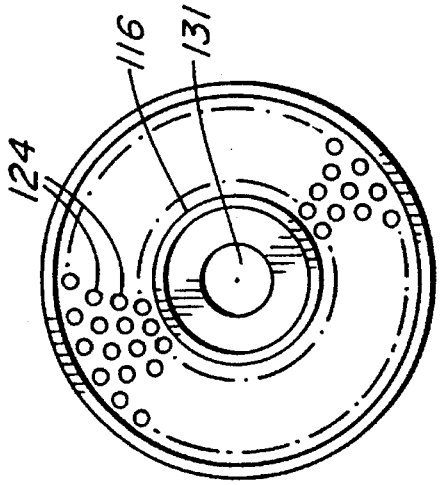
FIG. 5B is an end view taken along VB—VB of FIG. 5A.

A further embodiment of the invention is illustrated in FIG. 5 which shows an infrared burner generally illustrated at 100 and is useful to increase heating efficiency in many applications. This is accomplished by keeping the flame within the burner tube 111 so far as possible so that the flame heats the burner tube 111 to a red or white hot condition. To that end, the nozzle holder 101, nozzle 102, igniter 103 and the fuel and air inlets 104, 110, respectively, remain identical to those illustrated in the FIG. 1 embodiment. Likewise, primary air holes 111 are located in the nozzle holder 101.

However, the configuration of the burner tube 111 departs markedly from that of the FIG. 1 embodiment. In the configuration according to FIG. 5, it is the intention to keep the flame within the burner tube 111 and a closure member 112 is located at the end of the second portion 121 of the burner tube 111 distant or remote from the nozzle 102. Burner tube 111 has a circumferential configuration and extends axially or longitudinally from an interface 113 between the nozzle 102 and the burner tube 111 to the closure member 112. It has two areas, the first area 114 having a solid circumference and the second portion 121 having a plurality of holes 120 extending therethrough to the inside of the burner tube 111. Holes 120 appear on the top one half of the second portion 121 of burner tube 111 or all the way around the second portion 121 of the burner tube 111. To assist the burner 100 to keep the flame within the burner tube 111 and the outer axial area of the flame near the closure member 112, an inner tube 116 is located within the burner tube 111 principally within the solid or first portion 114 of the burner tube 111.

Figure 6A:
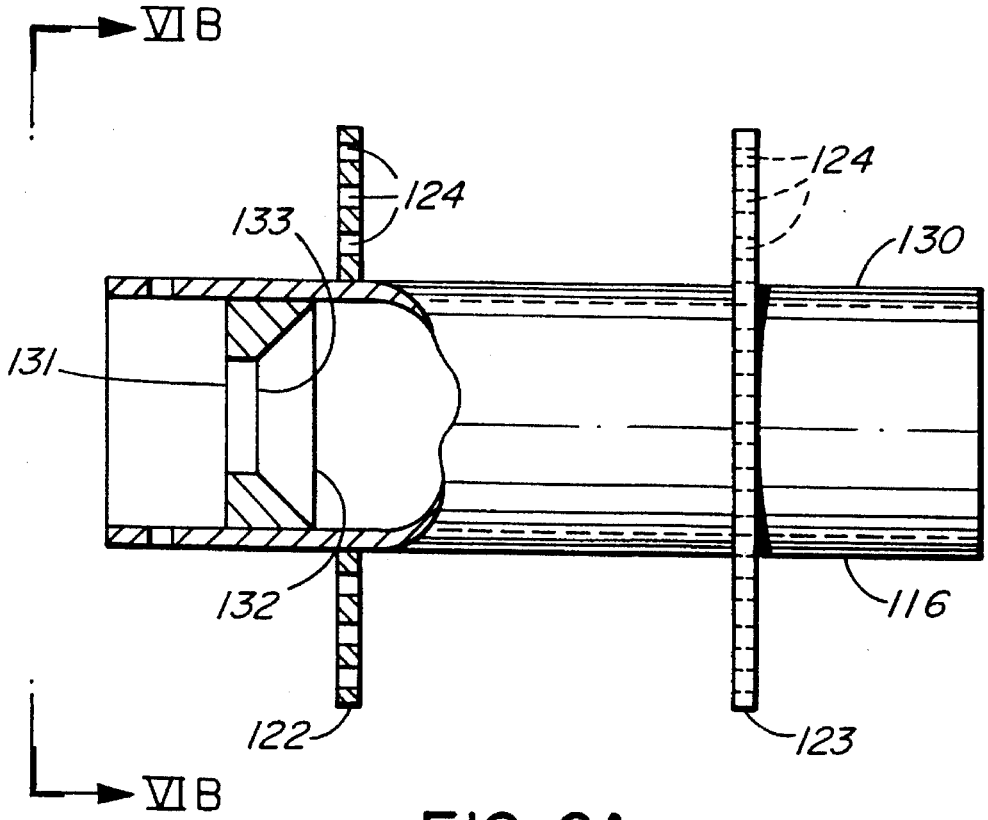
FIG. 6A is a side view of an inner tube which is used within the burner tube of FIG. 5.
Figure 6B:
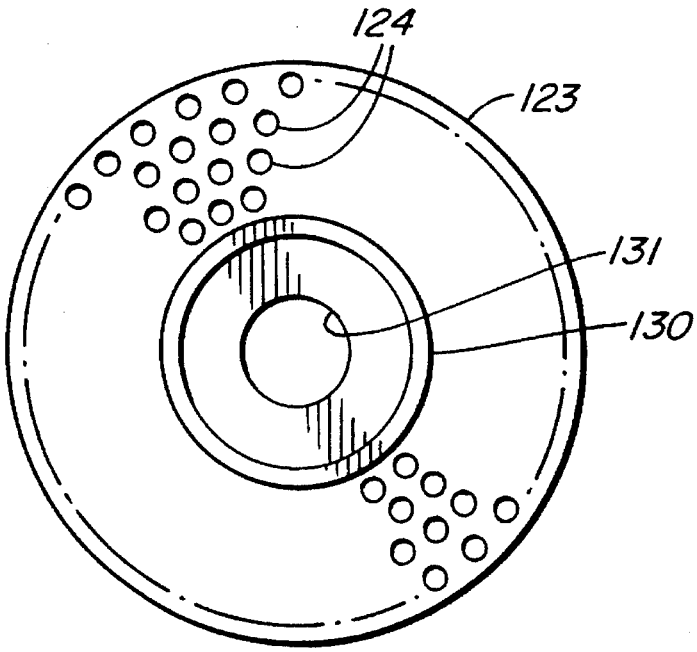
FIG. 6B is an end view taken along VIB—VIB of FIG. 6A.

The inner tube 116 is illustrated in greater detail in FIGS. 6A and 6B. It comprises first and second flame grids 122, 123, respectively, each with a plurality of holes 124 extending axially therethrough. A central circumferential member 130 extends longitudinally. Inwardly of each end of the circumferential member 130, the flame grids 122, 123, are located.

An orifice 131 is positioned within the member 130. The orifice 131 is tapered as illustrated; that is, it tapers from a first diameter 132 nearest the nozzle 102 to a second diameter 133 which is of a smaller value that the first diameter 132. The orifice 131 is intended to create a low pressure zone which exerts some influence on the flame formation and keeps it nearer the closure member 112 than extending outwardly from it and the burner tube 111. If the flame is retained within the inner tube 116, there is better heat transfer between it and the flame with the result that the burner tube 111 and particularly the second portion 121 of the burner tube 111 will be heated to a higher temperature.

Figure 7:
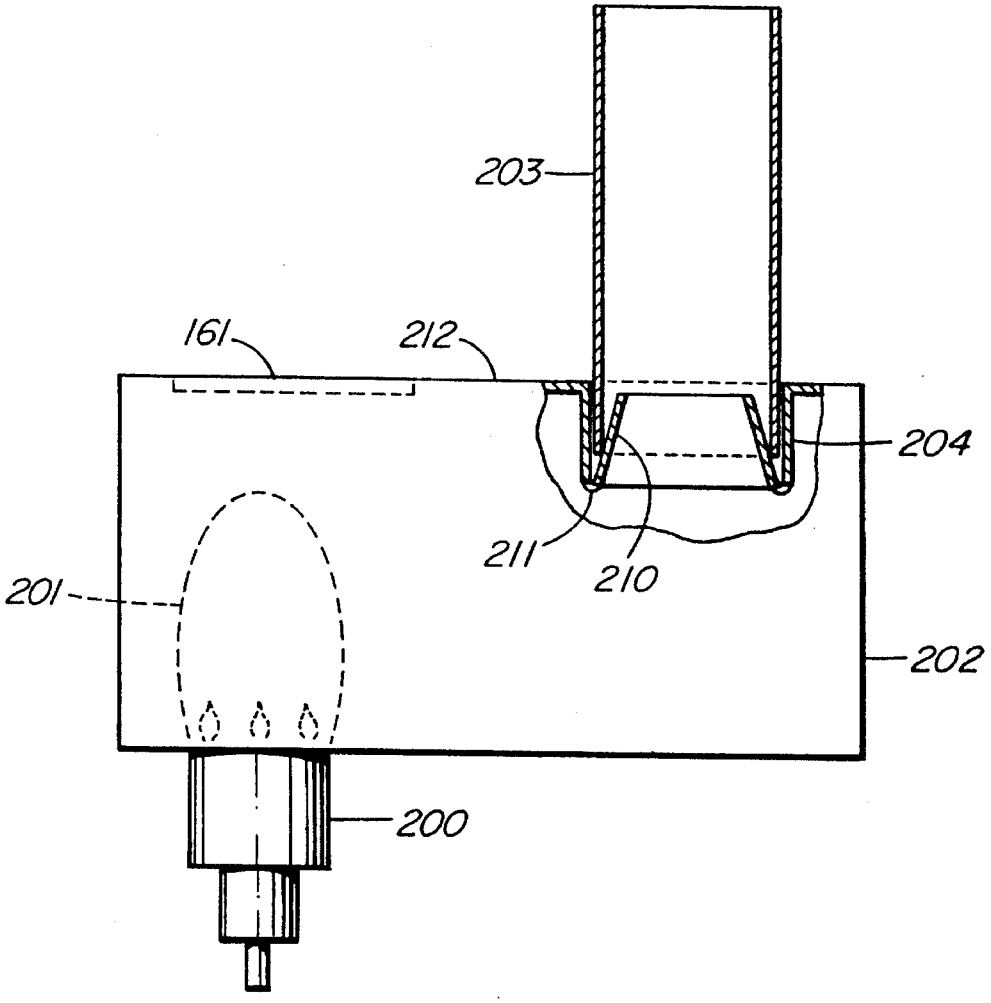
FIG. 7 is a diagrammatic side view of a heater body with a chimney and chimney collar according to a further aspect of the invention.

Yet a further embodiment of the invention is illustrated in FIG. 7. In this embodiment a burner is generally illustrated at 200 with its flame 201 diagrammatically shown. The burner 200 can be of the various configurations including the configuration of FIGS. 1–6 but, regardless of the configuration, it is mounted in a heater body or combustion chamber generally shown at 202 which may be positioned and operated in a shelter such as a tent or cabin (not illustrated) to heat the interior.

A chimney 203 is mounted at the outlet of the heater body 202 and is inserted into a joined outer straight collar 204 and a tapered inner collar 210 which is joined to the outer straight collar 204 by weld 211. Thus, the top 212 of the heater body 202 is flush with the top of outer and inner collars 204, 210, respectively, and facilitates cleaning and handling. Chimney 203 is secured to a greater extent when it is inserted into the circumferential "V" formed between the outer and inner collars 204, 210 and there is little or no possibility of air leakage between the chimney and the collars 204, 210 which would otherwise be the case when using chimney collars of known configuration.

Figure 8C:
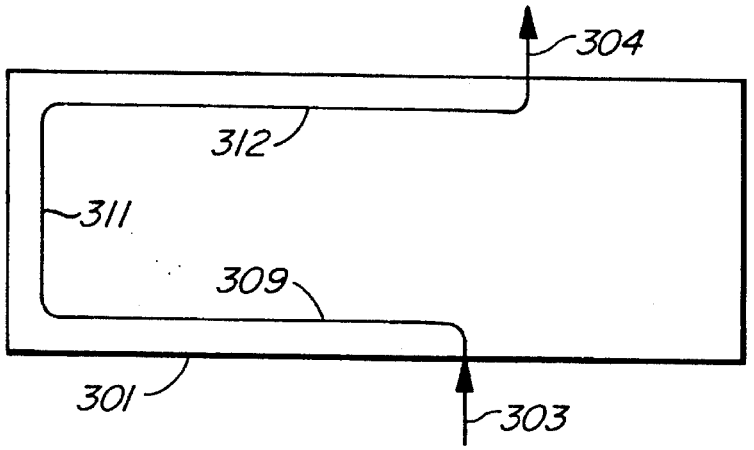
FIG. 8C is a diagrammatic view of the heat exchanger of FIGS. 8A and 8B showing the water circulation therein.
Figure 8A:
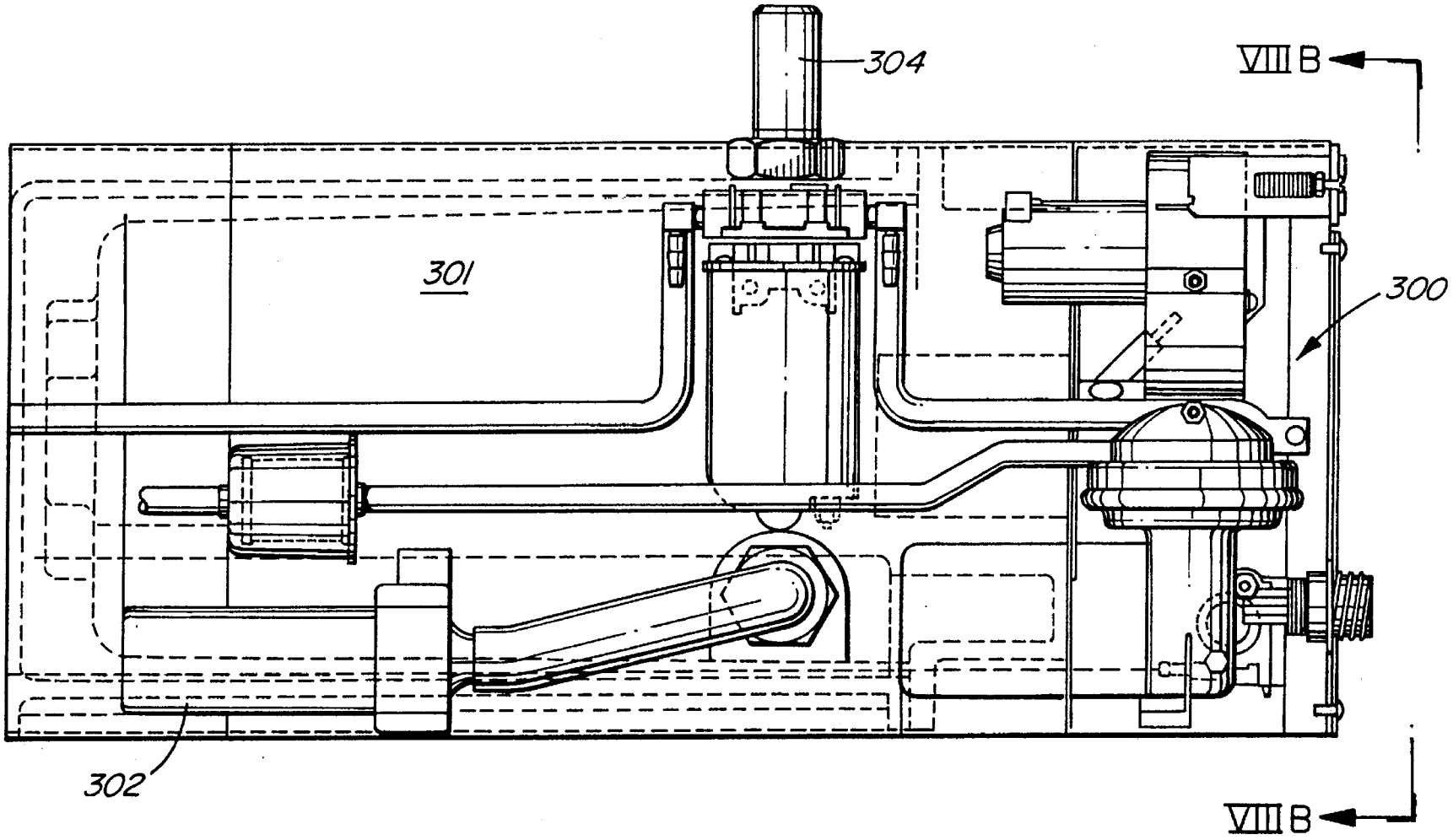
FIG. 8A is a side view of a heat exchanger used with the burner of FIG. 1.
Figure 8B:
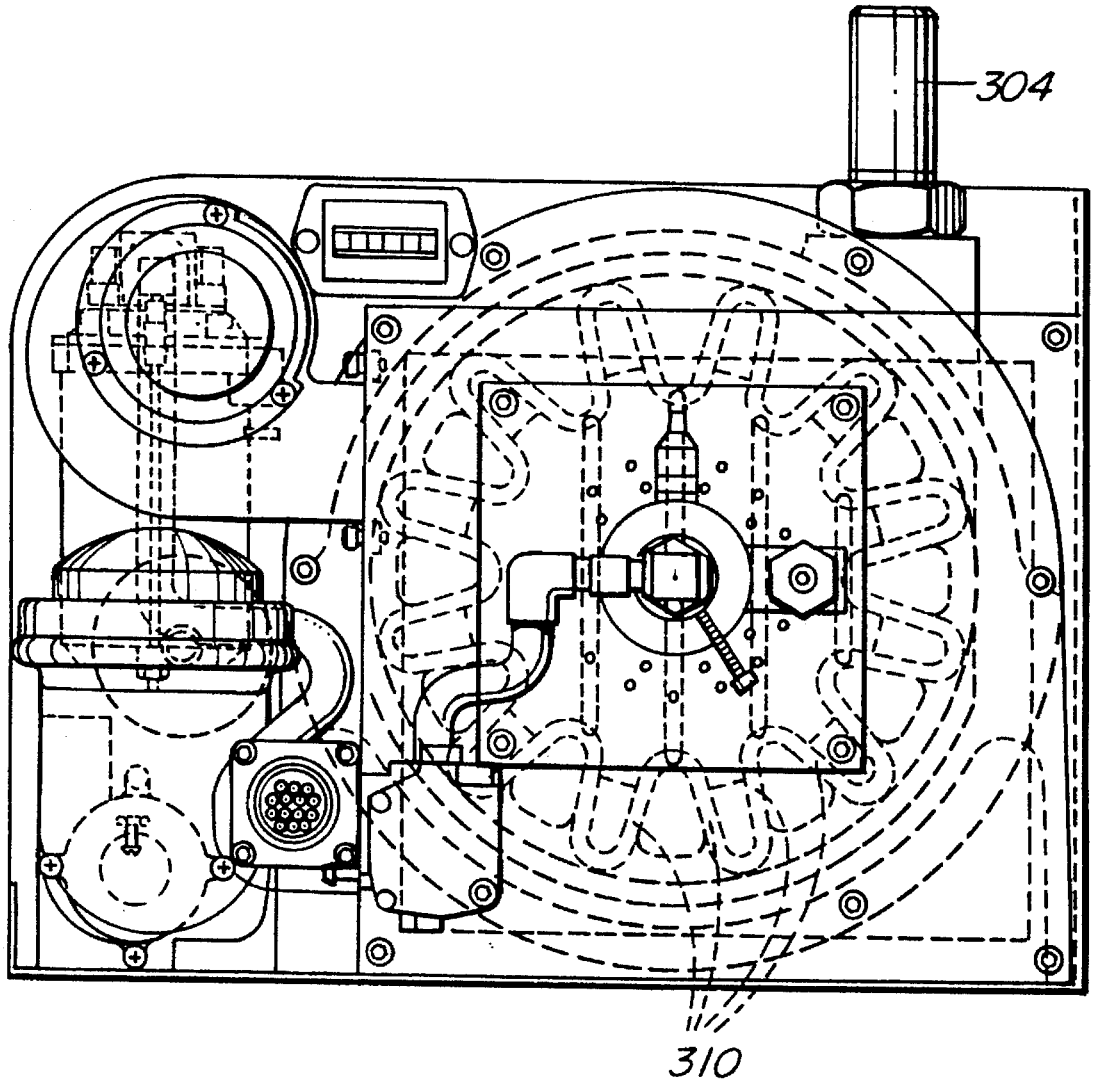
FIG. 8B is an end view of the heat exchanger of FIG. 8A taken along VIIIB—VIIIB of FIG. 8A.

Yet a further embodiment of the invention is illustrated in FIGS. 8A, 8B and 8C. In this embodiment, the burner assembly of FIG. 1 generally illustrated at 300 is mounted within a heat exchanger generally illustrated at 301. A circulating pump 302 provides for water to be introduced to the heat exchanger 301 through inlet 303 and which water exits the heat exchanger through outlet 304 after circulating through the heat exchanger 301 as seen diagrammatically in FIG. 8C.

The heat exchanger has a plurality of flutes or hat sections 310 (FIG. 8B) located about the circumference of the heat exchanger 301, the flutes 310 having an increased surface area which serves to more efficiently pass heat from the burner 300 to the water and which flutes 310 are made from cast aluminum. The lower one half of the flutes 310 are connected to the circumference of the heat exchanger 301 thereby to form a lower passageway 309 confining the water to the passageways on the lower half of the heat exchanger 301 until the leftward end is reached as illustrated in FIG. 8C. A channel or passageway 311 passes the water at the leftward end of the heat exchanger 301 to the upper passageway 312 which thereby confines the water to pass through the upper half of flutes 310 and out through outlet 304 as described.

The use of the heat exchanger 301 allows applications which require hot water. Such applications are well known and include maintaining water within water jackets of an engine in a heated condition thereby keeping an engine heated when otherwise shut down. The heated water could be used for many other purposes as is well known in the art.

While specific embodiments have been described, such descriptions should be taken as illustrative of the invention only and not as limiting its scope. Many modifications will readily occur to those skilled in the art to which the invention relates and, accordingly, the scope of the invention should be construed in accordance with the accompanying claims.

What is claimed is:

1. An infrared burner comprising a burner tube to support combustion within said burner tube, a nozzle holder operably connected to said burner tube, a nozzle operably inserted in said nozzle holder to inject atomized fuel from said nozzle into said burner tube, an igniter mounted in said nozzle holder such that said igniter is in the path of said atomized fuel emitted from said nozzle, a closure member for said burner tube, said closure member closing said burner tube at the end of said burner tube remote from said nozzle and radially directed holes through the outside circumference of the length of said burner tube, said radially directed holes extending longitudinally along said burner tube.

2. An infrared burner as in claim 1 wherein said burner tube is cylindrical.

3. An infrared burner as in claim 2 wherein said radially directed holes in said burner tube are located on the upper half thereof.

4. An infrared burner as in claim 3 wherein said closure member has axially directed holes extending therethrough.

5. An infrared burner as in claim 3 and further including an inner tubular member within said burner tube, said inner tubular member having a cylindrical configuration and a first flame grid extending circumferentially about said cylindrical member.

6. An infrared burner as in claim 5 and further comprising an orifice within said inner tubular member, said orifice extending across the inside circumference of said burner tube and being tapered inwardly from its upstream to its downstream end.

7. An infrared burner as in claim 6 wherein said first flame grid has a series of axially extending holes in said first flame grid.

8. An infrared burner as in claim 5 and further comprising a second flame grid circumferentially surrounding said inner tubular member, said second flame grid having a plurality of holes extending axially therethrough.

9. An infrared burner as in claim 8 and further including an orifice within said inner tubular member, said orifice extending across the inside circumference of said burner tube and being tapered inwardly from its upstream to its downstream end.

10. An infrared burner as in claim 9 and further comprising a series of holes extending radially through said inner tubular member, said orifice being positioned so air may pass through said holes to the inside of said inner tubular member.

11. An infrared burner as in claim 1 and further comprising a secondary air injection plate on the end of said burner tube closest to said nozzle, said secondary air injection plate having secondary air injection holes extending axially therethrough and allowing the entry of secondary air axially into said burner tube.

12. An infrared burner as in claim 1 and further comprising a heater body, said burner tube being mounted within said heater body, said heater body comprising a horizontal top, a first outer collar extending downwardly from said horizontal top, a second inner collar joined to said outer collar below the level of said horizontal top and a chimney with one end being operable to be inserted between said inner and outer collars.

13. An infrared burner as in claim 12 wherein said inner collar tapers downwardly and outwardly to join with said outer collar.

14. An infrared burner as in claim 13 wherein said inner and outer collars are joined by welding.

15. A heater body comprising a combustion chamber, a flat, upper surface, an opening to allow mounting of a burner within said combustion chamber and a chimney mount extending downwardly below said flat, upper surface, said chimney mount comprising outer and inner collar members joined together below said flat upper surface, and a chimney operable to be mounted between and in contact with said inner and outer collar members.

16. A heater body as in claim 15 wherein said inner collar tapers downwardly and outwardly to join with said outer collar.

* * * * *